US009702080B2

(12) United States Patent
Lee et al.

(10) Patent No.: US 9,702,080 B2
(45) Date of Patent: Jul. 11, 2017

(54) CLOTHING DRYER

(71) Applicant: SAMSUNG ELECTRONICS CO., LTD., Suwon-si (KR)

(72) Inventors: Tae Hyun Lee, Incheon (KR); Seong Min Oak, Changwon-si (KR); Do Haeng Kim, Suwon-si (KR); Yong Joon Jang, Suwon-si (KR); Ju Young Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 463 days.

(21) Appl. No.: 14/244,561

(22) Filed: Apr. 3, 2014

(65) Prior Publication Data

US 2014/0298671 A1 Oct. 9, 2014

(30) Foreign Application Priority Data

Apr. 3, 2013 (KR) ..... 10-2013-0036569

(51) Int. Cl.

*F26B 11/02* (2006.01)
*D06F 58/04* (2006.01)
*D06F 58/24* (2006.01)

(52) U.S. Cl.

CPC ..... *D06F 58/04* (2013.01); *D06F 58/24* (2013.01)

(58) Field of Classification Search

CPC ..... D06F 58/20; D06F 58/24; D06F 58/04; D06F 58/206
USPC ..... 34/79, 125, 602, 603, 192, 108, 85, 469, 34/292, 407, 449, 468, 73, 76
See application file for complete search history.

(56) References Cited

U.S. PATENT DOCUMENTS 3,595,086 A * 7/1971 Bonnet ..... A61B 5/1427 73/864.01
2006/0260150 A1* 11/2006 Doh ..... D06F 58/06 34/601

(Continued)

FOREIGN PATENT DOCUMENTS

CN 1724795 1/2006
DE 43 00 694 7/1994

(Continued)

OTHER PUBLICATIONS hotrodcoffeeshop.com, Got Waste Oil—Put it in a Laundry Bottle, Mar. 31, 2014, hotrodcoffeeshop.com, Sep. 7, 2013 edition, p. 2.*

(Continued)

*Primary Examiner* — Kenneth Rinehart
*Assistant Examiner* — John McCormack
(74) *Attorney, Agent, or Firm* — Staas & Halsey LLP

(57) ABSTRACT

A clothing dryer having an improved structure of a drainage unit thereof, including: a body; a drum; a base that is disposed at a lower portion of the drum; a first water tub that is mounted on the base to collect condensate water generated when a drying operation is performed; and a plurality of drainage pipes that are combined with one side of the first water tub and cause the condensate water to move, wherein, in order to change a position at which the plurality of drainage pipes and the first water tub are combined with each other, the first water tub is combined with edges of the base so that at least a part of the first water tub is able to be exposed to an outside.

20 Claims, 18 Drawing Sheets

(56) References Cited

U.S. PATENT DOCUMENTS

| | | | | |
|---|---|---|---|---|
| 2007/0006477 | A1* | 1/2007 | Guinibert | D06F 37/302 34/85 |
| 2010/0083532 | A1* | 4/2010 | Klug | D06F 39/022 34/597 |
| 2011/0012485 | A1* | 1/2011 | Busing | A47L 15/4217 312/228 |

FOREIGN PATENT DOCUMENTS

| | | | |
|---|---|---|---|
| DE | 195 24 578 | A1 | 1/1997 |
| DE | 10 2005 033 207 | B3 | 7/2006 |
| DE | 10 2007 052 835 | A1 | 5/2009 |
| DE | 10 2010 030 161 | A1 | 12/2011 |
| EP | 1 186 697 | A2 | 3/2002 |
| EP | 1 936 022 | A1 | 6/2008 |
| EP | 2 199 453 | | 6/2010 |
| WO | WO 2007/007089 | A1 | 1/2007 |

OTHER PUBLICATIONS

European Search Report issued Jun. 12, 2015 in corresponding European Patent Application No. 14163304.0.

* cited by examiner

CLOTHING DRYER

CROSS-REFERENCE TO RELATED APPLICATIONS

This application claims the benefit of Korean Patent Application No. P2013-36569, filed on Apr. 3, 2013 in the Korean Intellectual Property Office, the disclosure of which is incorporated herein by reference.

BACKGROUND

1. Field

Embodiments of the present disclosure relate to a clothing dryer, and more particularly, to a clothing dryer having an improved structure of a drainage unit thereof.

2. Description of the Related Art

Clothing dryers are devices that dry washed and wet laundry with high-temperature dry air.

In general, clothing dryers are classified into gas dryers and electric dryers depending on a power source or vented dryers and condenser dryers depending on a method of processing moisture absorbed from an object to be dried.

Vented dryers discharge humid air flowing from a drum to the outside through an elongated ventilation duct.

Condenser dryers use a method of removing and drying moisture from the humid air flowing from the drum using a heat-exchanging device and sending the air back to the drum so as to circulate the air. Since the flow of air constitutes a closed loop, it is difficult to use a gas as a heat source, and condenser dryers use mainly electricity and require a relatively large amount of maintenance cost. However, since the air circulates between the object to be dried in the drum and the heat-exchanging device, condenser dryers require no ventilation duct and thus can be simply installed.

Condensate water is generated when moisture is removed from the humid air using a dehumidifying unit of a clothing dryer. Such condensate water is collected on a base of the clothing dryer. If a predetermined amount of condensate water is collected, the condensate water is removed from the base through a pump.

A method of draining condensate water in the clothing dryer includes a method of draining condensate water using a recovery water tub and a method of directly draining condensate water from the base to an outer side of the clothing dryer. According to the related art, the number of components required for a drainage unit in order for a user to select a drainage method is large, and thus material cost increases.

SUMMARY

Therefore, it is an aspect of the present disclosure to provide a clothing dryer that is capable of improving the structure of a drainage unit of the clothing dryer so that the number of required components can be reduced, assembling characteristics of the drainage unit can be improved, and simultaneously condensate water can be prevented from bouncing.

Additional aspects of the disclosure will be set forth in part in the description which follows and, in part, will be obvious from the description, or may be learned by practice of the disclosure.

In accordance with one aspect of the present disclosure, a clothing dryer includes: a body; a drum that is rotatably installed in the body and accommodates an object to be dried; a base that is disposed at a lower portion of the drum;

a first water tub that is mounted on the base to collect condensate water generated when a drying operation is performed; and a plurality of drainage pipes that are combined with one side of the first water tub and cause the condensate water to move, wherein, in order to change a position at which the plurality of drainage pipes and the first water tub are combined with each other, the first water tub is combined with edges of the base so that at least a part of the first water tub is able to be exposed to an outside.

The clothing dryer may further include a first water tub cover that is combined with the first water tub so as to protect electronic units inside the first water tub.

The first water tub may include a drainage hole positioned at a top surface of the first water tub, with which the plurality of drainage pipes are combined, and to which the condensate water moves, and the first water tub cover may include a dent part in which at least a part of the first water tub cover is dented so that the drainage hole is able to be exposed to the outside.

At least one holder may be provided at the first water tub cover so as to fix at least one of the plurality of drainage pipes.

The clothing dryer may further include a second water tub for draining the condensate water collected in the first water tub.

The clothing dryer may further include a first drainage pipe in which the condensate water is moved from the first water tub to the second water tub.

The clothing dryer may further include a boss, which is disposed at one side of the first water tub and with which the first drainage pipe is combined so as to drain the condensate water in the first water tub toward an outer side of the body.

The clothing dryer may further include a second drainage pipe that connects the first water tub and the second water tub so as to move the condensate water that overflows in the second water tub to the first water tub.

The clothing dryer may further include a third drainage pipe that is combined with the drainage hole so as to drain the condensate water in the first water tub toward the outer side of the body.

A communication hole through which the condensate water moving via the first drainage pipe is accommodated in an inner side of the second water tub, may be provided in one side of the second water tub with which the first drainage pipe is combined.

The communication hole may be provided to be inclined toward the inner side of the second water tub.

The communication hole may include a first rib that is disposed at an inner side of the communication hole and corresponds to a shape of the communication hole and at least one second rib that is disposed at an inner side of the first rib.

A height of the second rib may be smaller than a height of the first rib.

A protrusion part may be provided at at least a part of the first rib and may protrude from an upper side of the first rib so as to prevent the condensate water flowing into the communication hole from bouncing toward an outer side of the communication hole.

An overflow hole may be provided in the other side of the second water tub so as to guide the condensate water overflowing in the communication hole to an inner side of the second water tub.

The communication hole may be provided to protrude from a surface of the second water tub more than the overflow hole.

In accordance with another aspect of the present disclosure, a clothing dryer includes: a body; a drum that is rotatably installed in the body and accommodates an object to be dried; a base that is disposed at a lower portion of the drum; and a drainage unit that is mounted on the base and collects and drains condensate water, wherein the drainage unit includes: a first water tub that collects the condensate water; a plurality of drainage pipes that are combined with the first water tub and cause the condensate water to be drained; and a first water tub cover that protects electronic units positioned at one side of the first water tub and that is combined with the first water tub so that a part of the plurality of drainage pipes is able to be exposed.

In accordance with still another aspect of the present disclosure, a clothing dryer includes: a body; a drum that is rotatably installed in the body and accommodates an object to be dried; a base that is disposed at a lower portion of the drum; a first water tub in which condensate water generated when an object to be dried is dried, is accommodated; a second water tub that takes out the condensate water collected in the first water tub from an outer side of the body so as to drain the condensate water; and a plurality of drainage holes with which a drainage pipe is combined so that the condensate water in the first water tub is able to be drained toward the second water tub or toward the outer side of the body, wherein the plurality of drainage holes are provided so that a user is able to select a drainage flow passage on which the condensate water is drained from the first water tub, from an outside.

In accordance with yet still another aspect of the present disclosure, a drainage unit includes: a first water tub in which condensate water generated when an object to be dried is dried, is accommodated; a second water tub that drains the condensate water collected in the first water tub; and a first drainage pipe that causes the condensate water in the first water tub to move to the second water tub, wherein the second water tub includes a communication hole provided in a surface of the second water tub so as to communicate with the first drainage pipe, and the communication hole is provided to be inclined from the surface of the second water tub to an inner side of the second water tub.

The communication hole may include a first rib that is disposed at an inner side of the communication hole and corresponds to a shape of the communication hole and at least one second rib that is disposed at an inner side of the first rib so as to guide the condensate water flowing into the communication hole, and a height of the at least one second rib may be smaller than a height of the first rib.

A protrusion part may be provided at at least a part of the first rib and protrude from an upper side of the first rib so as to prevent the condensate water flowing into the communication hole from bouncing toward an outer side of the communication hole.

An overflow hole may be provided in the other side of the second water tub so as to guide the condensate water overflowing in the communication hole to an inner side of the second water tub, and the communication hole may be provided to protrude from the surface of the second water tub more than the overflow hole.

A flow passage may be provided on the surface of the second water tub so as to guide the condensate water to at least one of the communication hole and the overflow hole.

The drainage unit may further include a second drainage pipe that causes the condensate water overflowing in the second water tub to move to the first water tub and a third drainage pipe that is combined with one side of the first water tub so as to drain the condensate water toward an outer side of the first water tub.

The drainage unit may further include: a drainage hole, which is provided in a first water tub body in which the condensate water is accommodated and with which at least one of the first drainage pipe and the second drainage pipe is combined; and a first water tub cover that is combined with the first water tub body so that at least one of the first drainage pipe and the second drainage pipe is able to be fixed and the drainage hole is able to be exposed to an outside.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
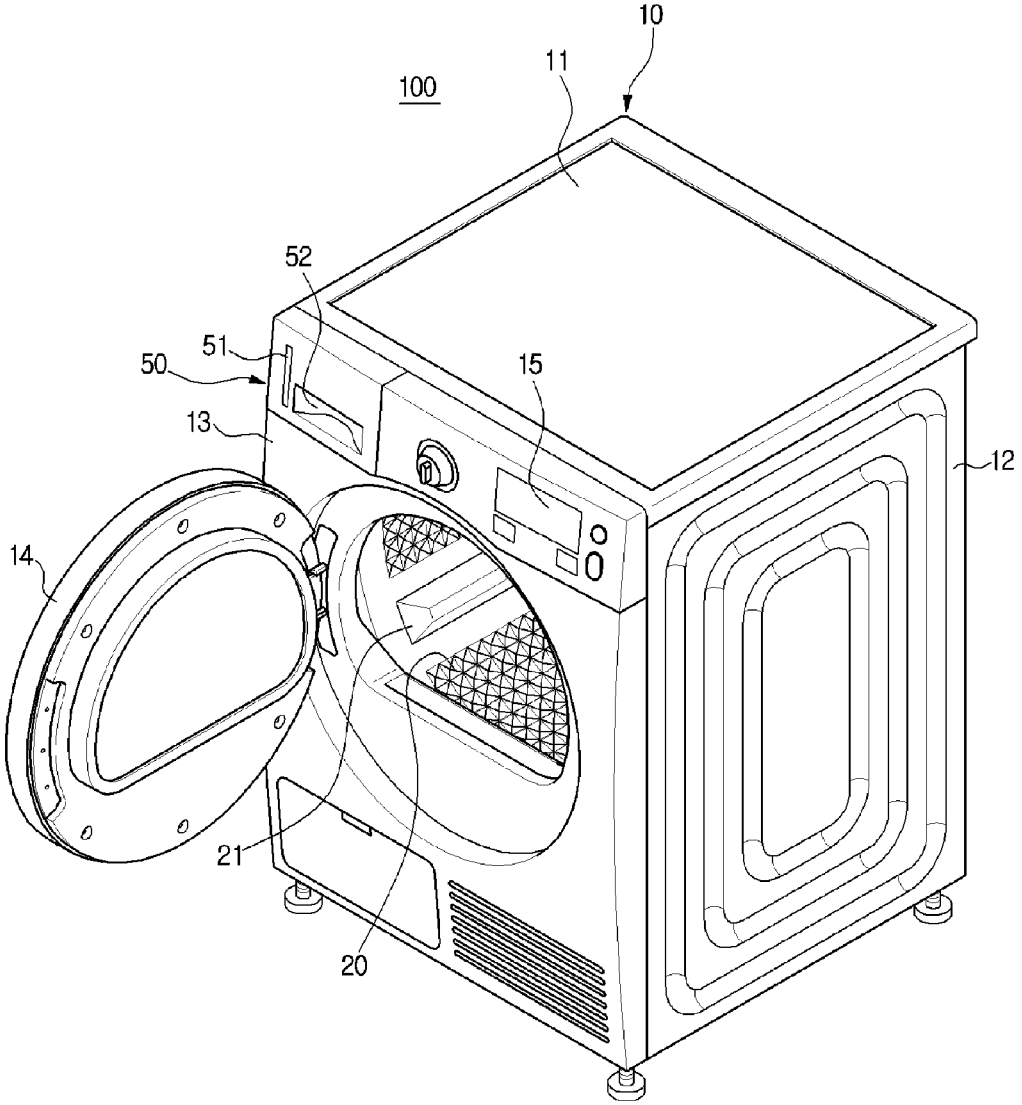
FIG. 1 is a view illustrating a front side of a clothing dryer according to an embodiment of the present disclosure.

Reference will now be made in detail to the embodiments of the present disclosure, examples of which are illustrated in the accompanying drawings, wherein like reference numerals refer to like elements throughout.

Figure 2:
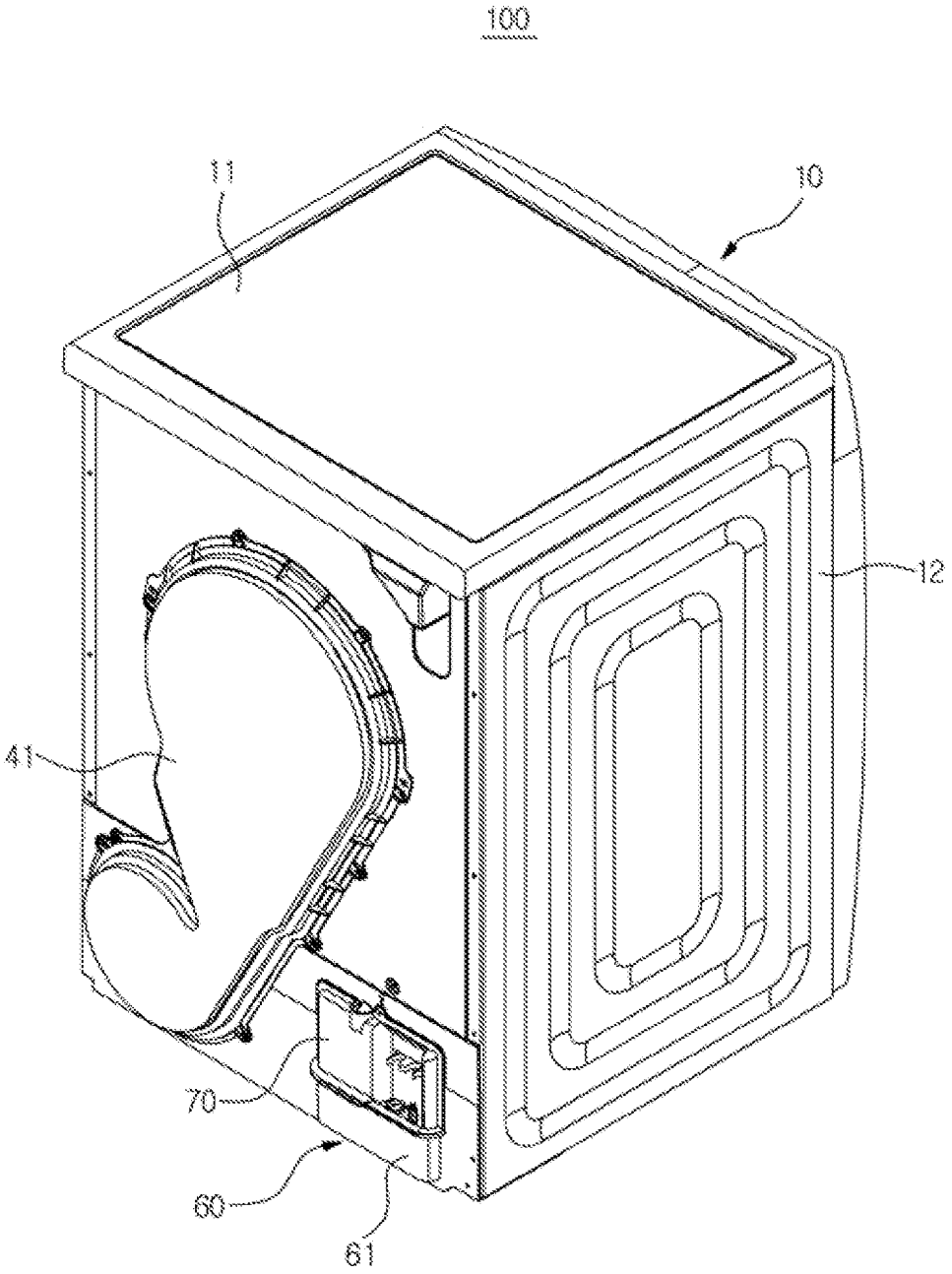
FIG. 2 is a view illustrating a rear side of the clothing dryer illustrated in FIG. 1.
Figure 3:
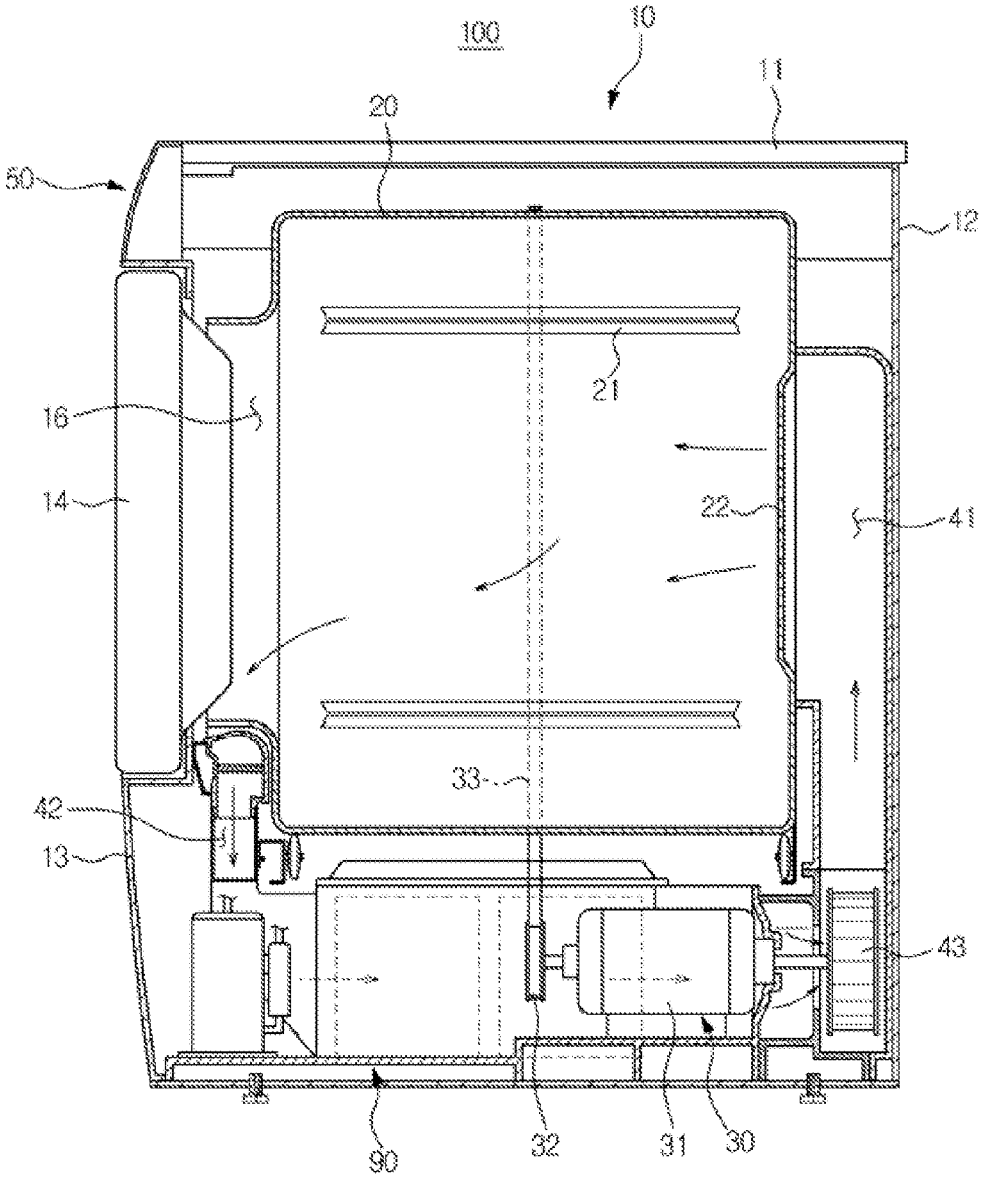
FIG. 3 is a view illustrating a configuration of the clothing dryer of FIG. 1.

FIG. 1 is a view illustrating a front side of a clothing dryer according to an embodiment of the present disclosure, FIG. 2 is a view illustrating a rear side of the clothing dryer illustrated in FIG. 1, and FIG. 3 is a view illustrating a configuration of the clothing dryer of FIG. 1.

As illustrated in FIGS. 1 through 3, a clothing dryer 100 includes a body 10, a drum 20, a driving unit 30, a dehumidifying unit (see 80 of FIG. 4), and drainage units 50 and 60.

The body 10 may include a frame 12, a top cover 11 that covers an upper portion of the frame 12, and a front panel 13 disposed at a front side of the frame 12. The body 10 may further include a first water tub 60 and a second water tub 50 that are the drainage units 50 and 60. The first water tub 60 is a waterspout tub in which condensate water is collected, and the second water tub 50 is a detachable water tub, which can be detached from the body 10 by a user and from which the condensate water in the first water tub 60 can be removed. The first water tub 60 is positioned at a lower side of the body 10 and accommodates the condensate water generated when an object to be dried is dried. The second water tub 50 may be positioned at an upper side of the body 10. The condensate water in the first water tub 60 may be drained to the second water tub 50, and the user may remove the condensate water from the second water tub 50 by taking out the second water tub 50 from the body 10. The condensate water in the first water tub 60 may be directly drained toward an outer side of the body 10, which will be described below.

Since a handle part 52 of the second water tub 50 is positioned on the front panel 13, the user may take out the second water tub 50 from the body 10 and may drain the condensate water accommodated in the second water tub 50 as needed. A display window 51 may be positioned at a front side of the second water tub 50. The display window 51 may be provided in a transparent form such that the user may determine the amount of the condensate water accommodated in the second water tub 50. The second water tub 50 will be described below. Also, a control panel 15 on which various buttons and displays for controlling the clothing dryer 100 are disposed, may be positioned on the front panel 13.

A laundry port 16 through which the object to be dried may be put into the drum 20, is disposed at a front side of the body 10, and a door 14 is hinge-coupled to the front of the laundry port 16 so as to open and close the laundry port 16.

The first water tub 60 of the drainage units 50 and 60 is positioned at a rear side of the body 10. The first water tub 60 may be positioned at edges of the rear side of the body 10. The first water tub 60 may include a first water tub body 61 and a first water tub cover 70. Since the first water tub body 61 and the first water tub cover 70 are combined with each other, the user may determine whether the condensate water is to be drained toward an outer side of the body 10 or toward the second water tub 50 without the need of detaching the first water tub cover 70 from the first water tub 60. An inflow duct 41 may be combined with the rear side of the body 10 such that the air from which humidity is removed may flow from an inner side of the inflow duct 41 into the drum 20.

The drum 20 in which the object to be dried is accommodated, is rotatably installed in the body 10. A plurality of lifters 21 are disposed in the drum 20 along a circumferential direction of the drum 20. The plurality of lifters 21 cause the object to be dried to ascend or descend such that the object to be dried can be effectively dried.

The drum 20 is driven by the driving unit 30. The driving unit 30 may include a driving motor 31 to be mounted in a base 90. The driving motor 31 may include a pulley 32 rotated by a rotational force of the driving motor 31 and a belt 33 that transfers power of the driving motor 31 to the drum 20 by connecting the pulley 32 and the drum 20.

A front side of the drum 20 is opened so that the object to be dried can be put into the drum 20, and the front side of the drum 20 is closed by the door 14. A hot wind inlet 22 is formed at a rear side of the drum 20, and the air heated by the dehumidifying unit 80 flows into the drum 20 via the hot wind inlet 22.

The object to be dried may be dried by the air flowing into the drum 20. The humid air discharged from the drum 20 flows into the dehumidifying unit 80 along a discharge duct 42. The air dried after passing through the dehumidifying unit 80 is circulated into the drum 20 along the inflow duct 41.

The flow of air described above occurs due to a blower fan 43 installed at a lower side of the inflow duct 41.

The discharge duct 42 is disposed at the front of the drum 20 and guides discharge of the high-temperature humid air that passes through an inner side of the drum 20. A filter (not shown) may be installed at the discharge duct 42 so as to filter foreign substances such as lint.

The inflow duct 41 is disposed at the rear of the drum 20 and communicates with the inner side of the drum 20 via the hot wind inlet 22 formed at the drum 20.

The blower fan 43 is disposed inside the inflow duct 41. The blower fan 43 absorbs the high-temperature dry air that passes through the dehumidifying unit 80 and discharges the high-temperature dry air into the inflow duct 41, thereby generating an air circulation that passes through the drum 20. The blower fan 43 may be driven together by the driving motor 31 that drives the drum 20.

Figure 4:
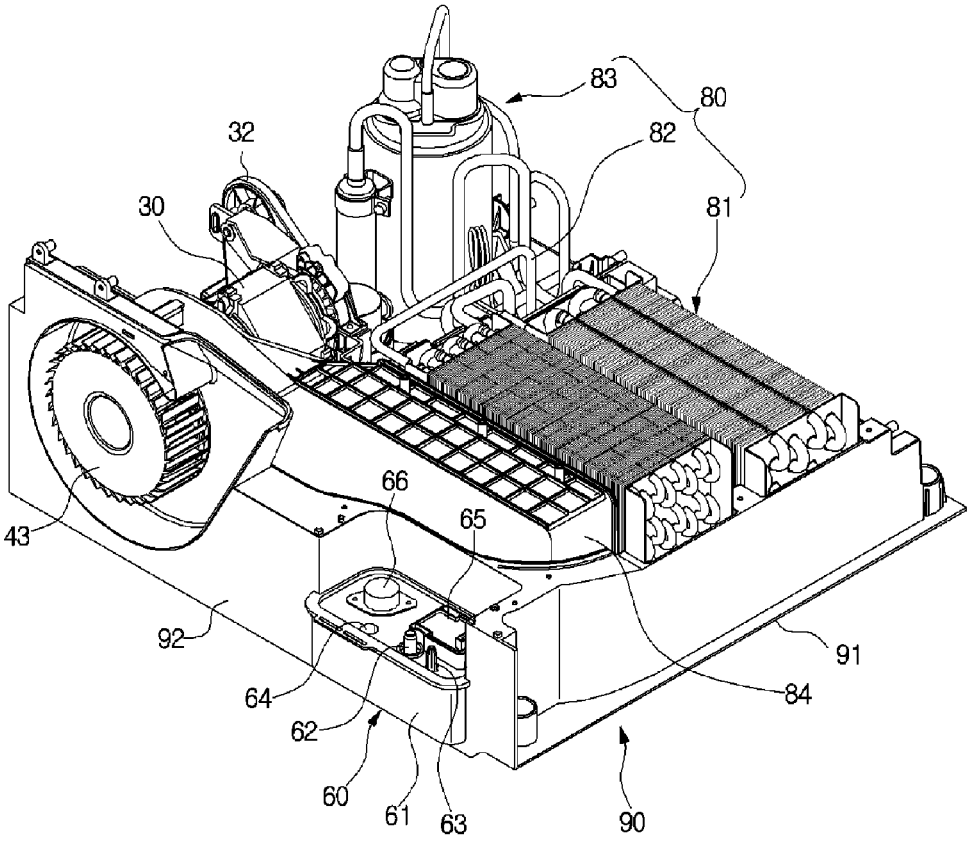
FIG. 4 is a view illustrating a base of the clothing dryer of FIG. 1.

FIG. 4 is a view illustrating the base of the clothing dryer of FIG. 1.

As illustrated in FIG. 4, the base 90 is mounted on a lower portion of the drum 20. A base body 91 constitutes the exterior of the base 90. A rear body 92 on which the blower fan 43 is mounted and the first water tub 60 that will be described below is formed, may be mounted at the rear of the base body 91.

The first water tub 60 among the dehumidifying unit 80, the driving unit 30, the blower fan 43, and the drainage units 50 and 60 described above may be mounted on the base 90. In detail, the dehumidifying unit 80 and the driving unit 30 may be mounted on the base body 91, and the blower fan 43 and the first water tub 60 may be mounted on the rear body 92.

A part of the discharge duct 42 may be formed at a portion of the rear body 92 on which the blower fan 43 is mounted. The first water tub cover 70 may be additionally combined with a portion of the rear body 92 in which the first water tub 60 is disposed, so as to protect electronic units inside the waterspout tub 60.

A base cover (not shown) may be combined with an upper portion of the base body 91 so as to cover the dehumidifying unit 80 and the driving unit 30.

The dehumidifying unit 80 may include an evaporator 81, a condenser 82, and a compressor 83. Although not shown, the dehumidifying unit 80 may further include an expansion valve.

The high-temperature humid air discharged from the drum 20 flows in the dehumidifying unit 80.

The high-temperature humid air first passes through the evaporator 81 of the dehumidifying unit 80. A refrigerant that expands due to pressure drop and absorbs heat passes through the evaporator 81. The refrigerant is evaporated by the evaporator 81 and absorbs heat, while the high-temperature humid air is cooled, loses moisture, and becomes a low-temperature dry air. That is, the high-temperature humid air discharged from the drum 20 passes through the evaporator 81 and is changed to the low-temperature dry air.

The low-temperature dry air that passes through the evaporator 81 passes through the condenser 82. The refrigerant that is compressed by the compressor 83 and is overheated passes through an inner side of the condenser 82. The overheated refrigerant passes through the condenser 82 and dissipates heat, while the low-temperature dry air is heated and becomes a high-temperature dry air. That is, the low-temperature dry air discharged from the evaporator 81 passes through the condenser 82 and is changed to the high-temperature dry air.

The high-temperature dry air that passes through the condenser 82 is guided to the inflow duct 41 along a guide duct 84. The high-temperature dry air guided to the inflow duct 41 flows in the drum 20 along the inflow duct 41 due to the blower fan 43.

If a drying operation starts being performed, the driving motor 31 operates and thus the drum 20 and the blower fan 43 operate. The blower fan 43 causes the flow of air. The air passes through the evaporator 81 and the condenser 82, is changed to the high-temperature dry air, and flows in the drum 20. The high-temperature dry air flowing in the drum 20 takes out moisture from the object to be dried put into the drum 20 and dries the object to be dried. Simultaneously, the air is changed to the high-temperature humid air. The high-temperature humid air is put into the dehumidifying unit 80 along the discharge duct 42 and is changed to the high-temperature dry air. The high-temperature dry air is put into the drum 20 again.

When the high-temperature humid air discharged from the drum 20 is cooled by the evaporator 81 and discharges moisture, the condensate water may be generated. The condensate water is collected in the first water tub 60 mounted on the base 90. The collected condensate water may move to the second water tub 50 and the user may take out the second water tub 50 so as to drain the condensate water or may drain the condensate water from the first water tub 60 toward an outer side of the body 10. A state in which the condensate water is positioned in the first water tub 60, is defined as a first state, and a state in which the condensate water is pumped and moves to the second water tub 50, is defined as a second state. Also, a state in which the condensate water is pumped and is drained toward the outer side of the body 10, is defined as a third state. Also, a state in which the condensate water inside the second water tub 50 overflows and moves to the first water tub 60, is defined as a fourth state. The user may change a position at which a drainage pipe and the first water tub 60 are combined with each other and may determine whether the condensate water is in the second state or the third state. That is, the user may select a drainage flow passage of the condensate water drained from the first water tub 60.

Figure 5:
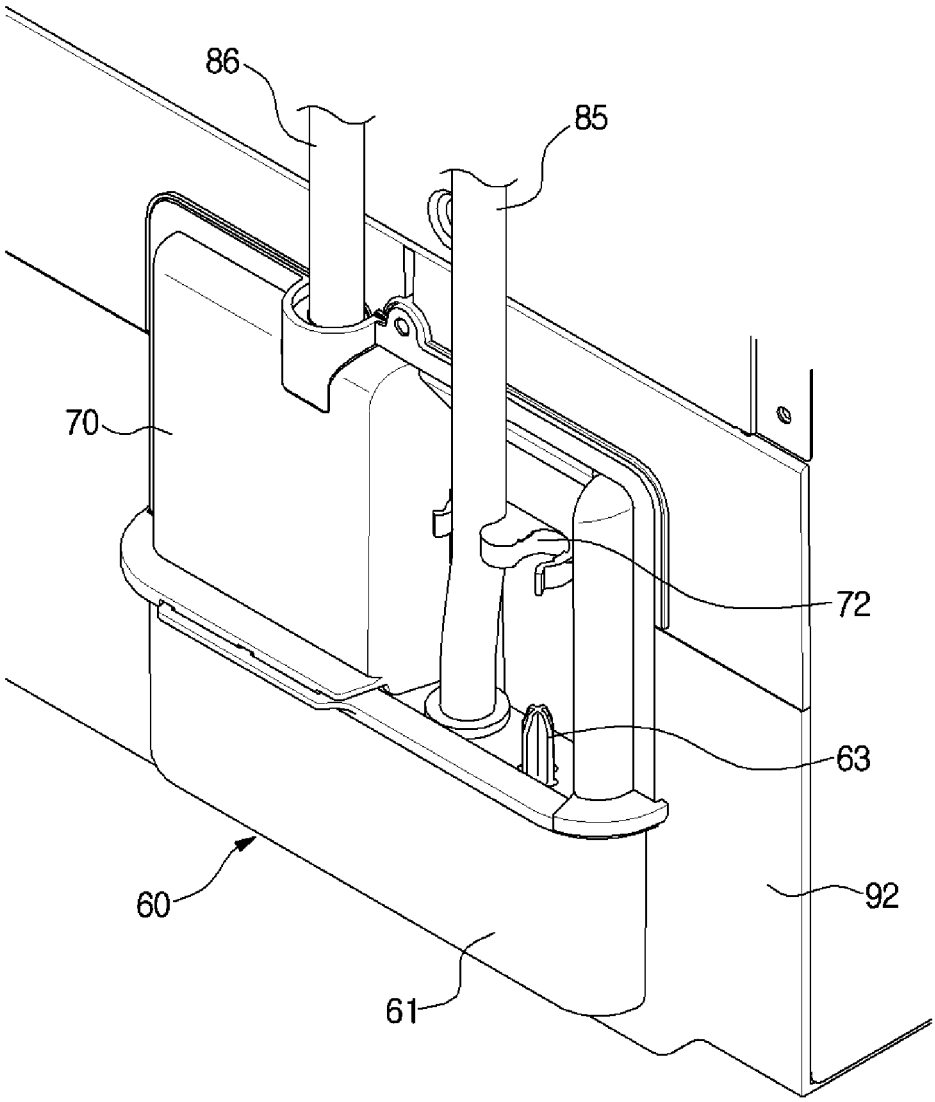
FIG. 5 is a view illustrating a first water tub according to an embodiment of the present disclosure.
Figure 6:
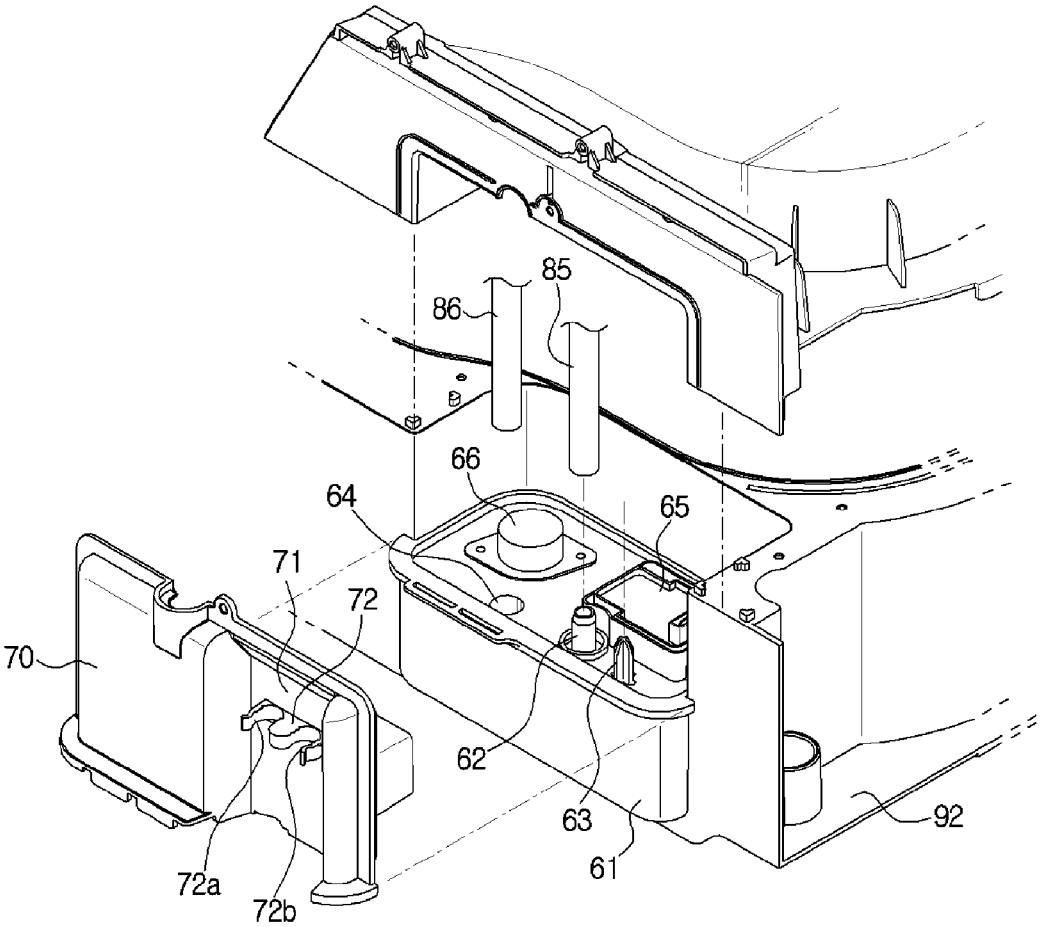
FIG. 6 is an exploded view illustrating a cover of the first water tub illustrated in FIG. 5.

FIG. 5 is a view illustrating a first water tub according to an embodiment of the present disclosure, and FIG. 6 is an exploded view illustrating a cover of the first water tub illustrated in FIG. 5.

As illustrated in FIGS. 5 and 6, the first water tub 60 may be formed at the rear of the rear body 92. According to an embodiment of the present disclosure, a part of the rear body 92 may be dented, and the first water tub 60 may be formed integrally with the dented part of the rear body 92. However, unlike this, a structure in which the first water tub 60 is formed separately from the rear body 92 and the first water tub 60 is mounted on the rear body 92, may be included in the spirit of the present disclosure.

The first water tub 60 may include the first water tub body 61. At least one drainage pipe 85, 86, and 87 (see FIG. 8) may be combined with the first water tub 60. A drainage pipe in which the condensate water is moved from the first water tub 60 to the second water tub 50, is defined as a first drainage pipe 85, a drainage pipe in which the condensate water is moved from the second water tub 50 to the first water tub 60, is defined as a second drainage pipe 86, and a drainage pipe in which the condensate water is moved from the first water tub 60 to the outer side of the body 10, is defined as a third drainage pipe 87.

At least one drainage hole 62 and 64 may be provided in a top surface of the first water tub 60. According to the drawings, a first drainage hole 62 with which the first drainage pipe 85 or the third drainage pipe 87 is combined, and a second drainage hole 64 with which the second drainage pipe 86 is combined, may be provided in the top surface of the first water tub 60. The third drainage pipe 87 is not used in the second state and is additionally combined with the first drainage hole 62 in the third state. Thus, the third drainage pipe 87 is additionally provided to the user. Also, when the first drainage pipe 85 is not used for the purpose of drainage in the third state, a boss 63 with which the first drainage pipe 85 is combined, may be provided close to the first drainage hole 62.

Electronic units for draining the condensate water may be positioned inside the first and second drainage holes 62 and 64. A drainage pump 65 that pumps and drains the condensate water and a water level sensing sensor 66 that senses a water level of the condensate water may be provided as the electronic units. The drainage pump 65 may pump the condensate water such that the condensate water can be drained toward the second water tub 50 or toward the outer side of the body 10.

The first water tub cover 70 may be combined with the first water tub body 61 so as to protect the electronic units inside the first water tub body 61. The first water tub cover 70 may be combined with the first water tub body 61 so that at least one of the drainage holes 62 and 64 can be exposed to the outside. The first water tub cover 70 includes a dent part 71 in which at least a part of the first water tub cover 70 is dented. As a result, at least one of the discharge holes 62 and 64 can be exposed to the outside. According to the drawings, the first drainage hole 62 and the boss 63 are exposed to the outside due to the dent part 71. However, aspects of the present disclosure are not limited thereto.

The first water tub cover 70 may include at least one holder 72 so as to fix at least one of the drainage pipes 85, 86, and 87. At least one of the drainage pipes 85, 86, and 87 may be inserted into spaces 72*a* and 72*b* formed by the holder 72 such that at least one of the drainage pipes 85, 86, and 87 can be fixed. According to an embodiment of the present disclosure, the holder 72 is provided so that the spaces 72*a* and 72*b* in which two drainage pipes may be inserted, can be formed.

Figure 7:
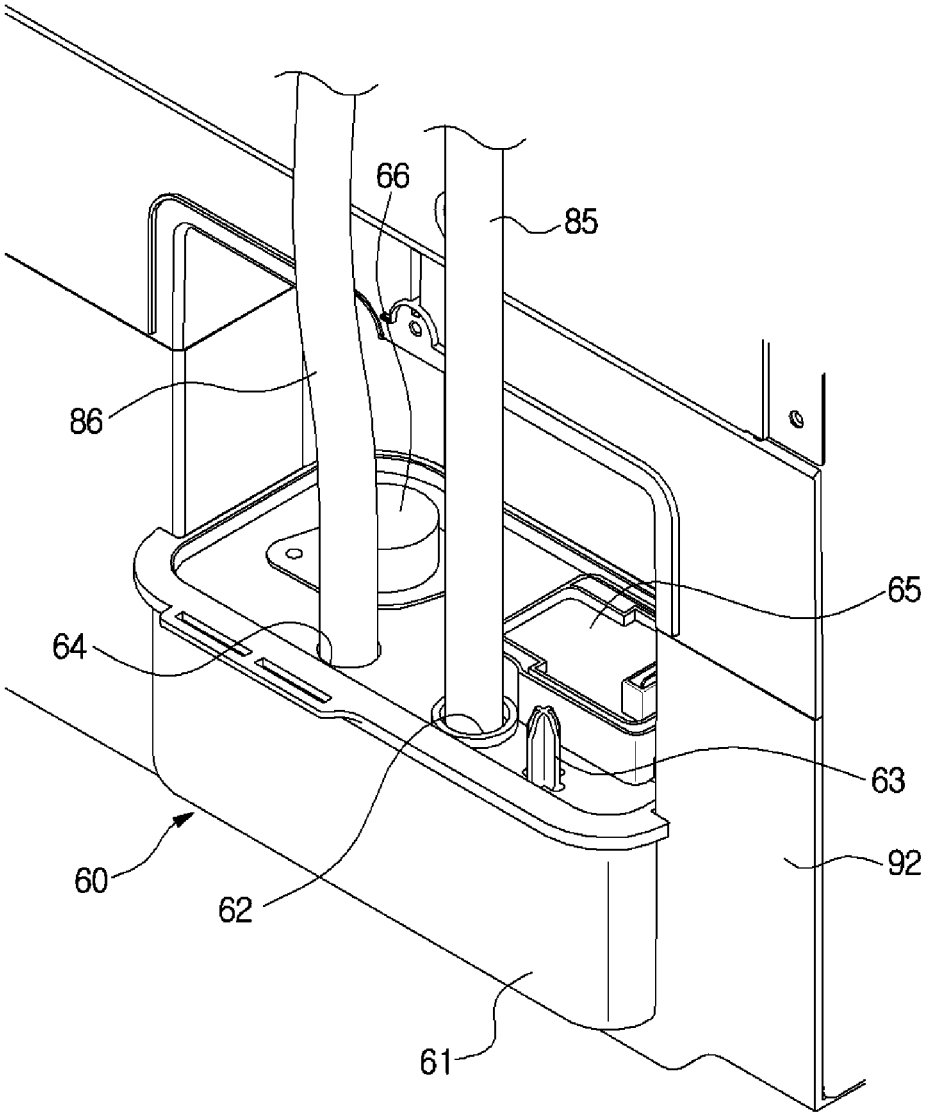
FIG. 7 is a view illustrating a drainage pipe combined structure when condensate water is drained using a second water tub, according to an embodiment of the present disclosure.
Figure 8:
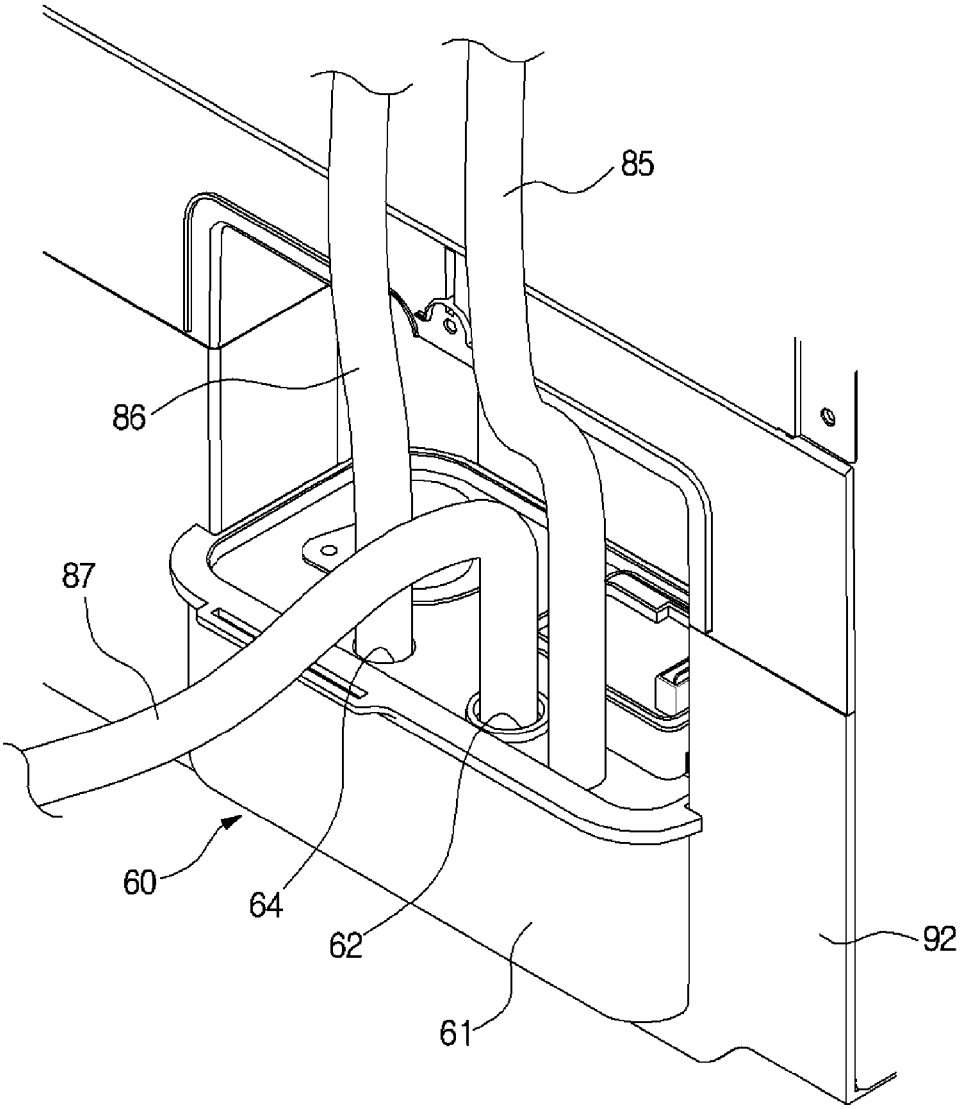
FIG. 8 is a view illustrating a drainage pipe combined structure when the condensate water is drained toward an outer side of a body using a drainage pipe, according to an embodiment of the present disclosure.

FIG. 7 is a view illustrating a drainage pipe combined structure when the condensate water is drained using a recovery water tub, according to an embodiment of the present disclosure, and FIG. 8 is a view illustrating a drainage pipe combined structure when the condensate water is drained toward an outer side of a body using a drainage pipe, according to an embodiment of the present disclosure.

A connection structure of drainage pipes depending on a drainage state will now be described with reference to FIGS. 7 and 8.

FIG. 7 illustrates a drainage pipe combined structure in the second state in which the condensate water is drained using the second water tub 50.

The second drainage pipe 86 is combined with the second drainage hole 64 and is used in the fourth state in which the condensate water overflowing in the second water tub 50 is moved to the waterspout tub 60. The first drainage pipe 85 is combined with the first drainage hole 62 and causes the condensate water collected in the first water tub 60 to move to the second water tub 50. The first drainage pipe 85 may be inserted into and fixed to the holder 72.

FIG. 8 illustrates a drainage pipe combined structure in the third state in which the condensate water is drained from the first water tub 60 to the outer side of the body 10.

The second drainage pipe 86 is combined with the second drainage hole 64 and causes the condensate water overflowing in the second water tub 50 to move to the first water tub 60. However, the third drainage pipe 87 is combined with the first drainage hole 62 and causes the condensate water in the first water tub 60 to be drained toward the outer side of the body 10. In this case, the first drainage pipe 85 is not used in drainage of the condensate water and thus is combined with the boss 63.

That is, the condensate water is accommodated in the first water tub 60 in the first state. The condensate water accommodated in the first water tub 60 in the second state moves to the second water tub 50 through the first drainage pipe 85 combined with the first drainage hole 62. The third state is a state in which the user combines the first drainage pipe 85 with the boss 63 and the third drainage pipe 87 with the first drainage hole 62 such that the condensate water can be drained toward the outer side of the boy 10. The fourth state is a state in which the second drainage pipe 86 is combined with the second drainage hole 64 and the condensate water overflowing in the second water tub 50 moves to the first water tub 60. Movement of the condensate water may occur simultaneously in the first state, the second state, and the third state unless the combined structure of the second drainage pipe 86 is not changed.

In this way, since the first water tub cover 70 is combined with the first water tub body 61 so that the first drainage hole 62 can be exposed to the outside, the user may combine the first drainage pipe 85 or the third drainage pipe 87 with the first drainage hole 62 depending on a desired drainage method without the need of removing the first water tub cover 70. Also, since the first water tub cover 70 includes the holder 72 for fixing the drainage pipes 85, 86, and 87, the number of components required to manufacture the drainage units 50 and 60 can be reduced and thus assembling characteristics of the drainage units 50 and 60 can be improved and production efficiency can be improved.

Figure 9:
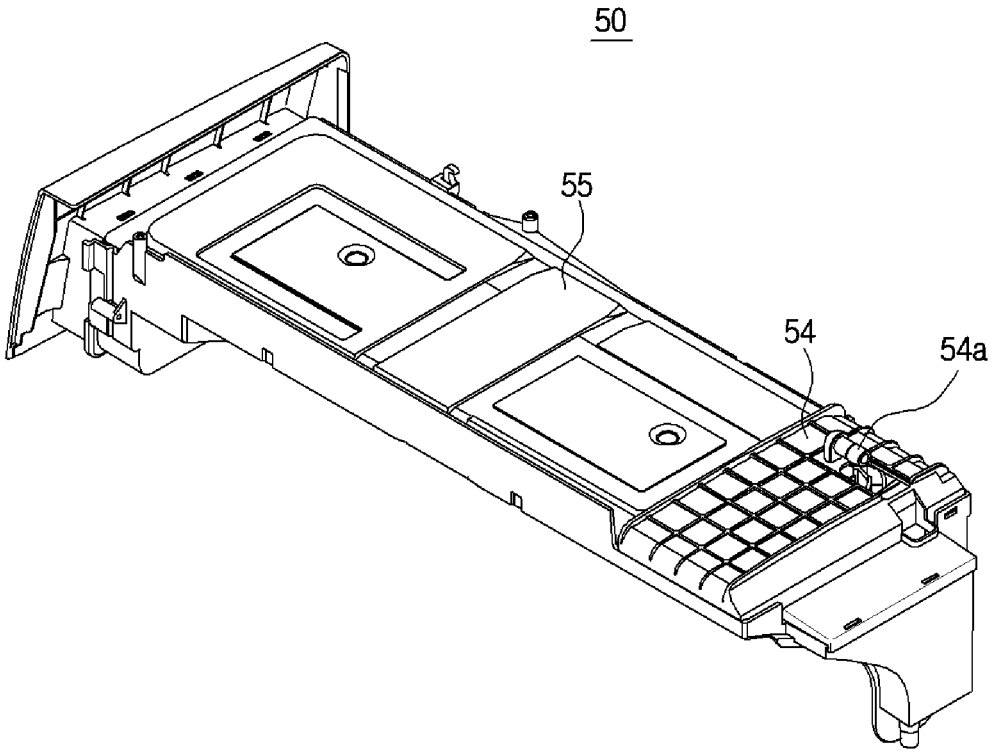
FIG. 9 is a view illustrating a second water tub according to an embodiment of the present disclosure.
Figure 10:
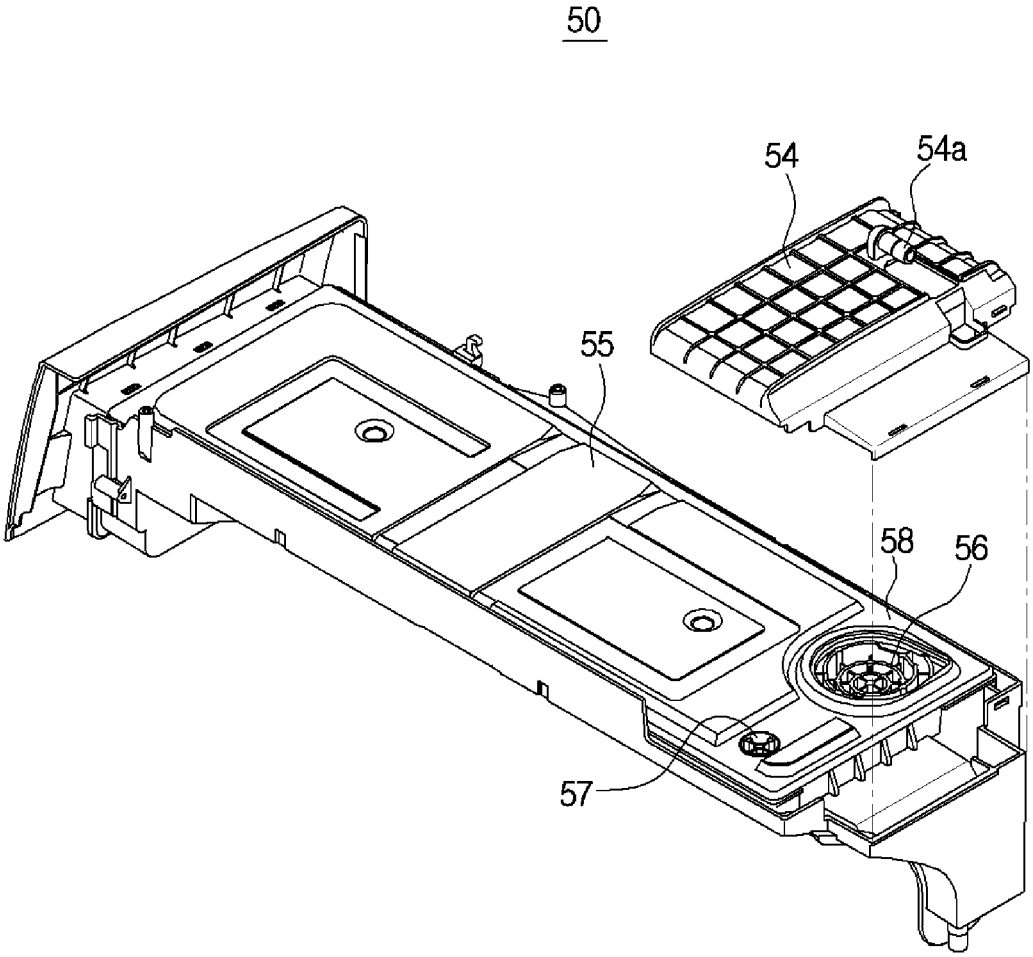
FIG. 10 is a view illustrating a state in which a second water tub cover of the second water tub illustrated in FIG. 9 is removed.

FIG. 9 is a view illustrating a second water tub according to an embodiment of the present disclosure, and FIG. 10 is a view illustrating a state in which a second water tub cover of the second water tub illustrated in FIG. 9 is removed.

As illustrated in FIGS. 9 and 10, the second water tub 50 may include a second water tub body 55 and a second water tub cover 54. The second water tub 50 may include the handle part (see 52 of FIG. 1), which is positioned at a front side of the clothing dryer 100 and through which the user may grasp and take out the second water tub 50 that is a recovery water tub.

The second water tub cover 54 may be combined with a part of a top surface of the second water tub body 55. The first drainage pipe 85 combined with the first water tub 60 may be combined with one side of the second water tub cover 54. The first drainage pipe 85 may be combined with an inflow pipe 54*a* of the second water tub cover 54. The second water tub cover 54 may be combined with the body 10. Thus, when the user takes out the second water tub 50, the second water tub cover 54 is not taken out but only the second water tub body 55 is taken out. When the second water tub body 55 is inserted into the body 10, a rear side of the second water tub body 55 and an inner side of the second water tub cover 54 contact each other.

A communication hole 56 through which the condensate water is guided to an inner side of the second water tub 50 may be provided in one side of the top surface of the second water tub body 55. The communication hole 56 is provided so that the condensate water in the first drainage pipe 85 can flow in the communication hole 56. The communication hole 56 will be described later.

An overflow hole 57 through which the condensate water that does not flow in the communication hole 56 and overflows can be accommodated in the second water tub 50, may be provided in the other side of the top surface of the second water tub body 55. A flow passage 58 may be provided on the top surface of the second water tub body 55 so as to guide movement of the condensate water. Also, the communication hole 56 may be provided to protrude from the top surface of the second water tub body 55 more than the overflow hole 57. This is to guide the condensate water overflowing from the communication hole 56 to flow in the overflow hole 57.

Figure 11:
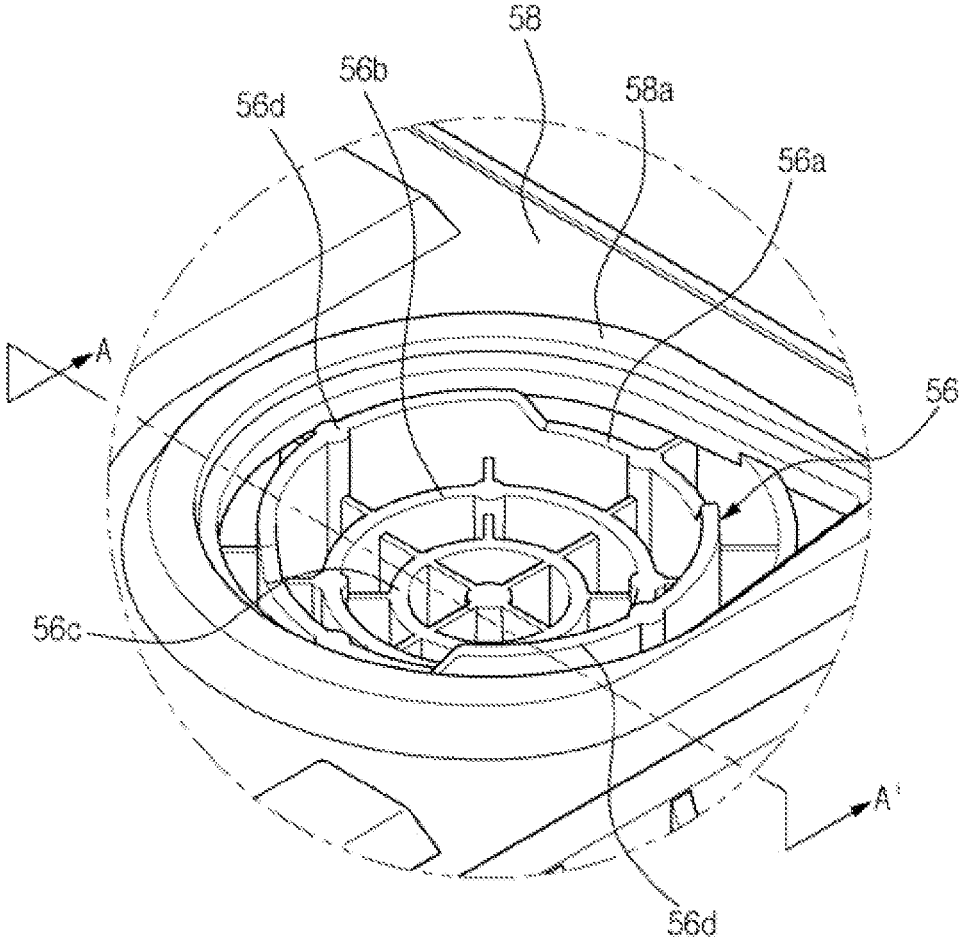
FIG. 11 is an enlarged view illustrating a drainage hole of the second water tub of FIG. 9.
Figure 12:
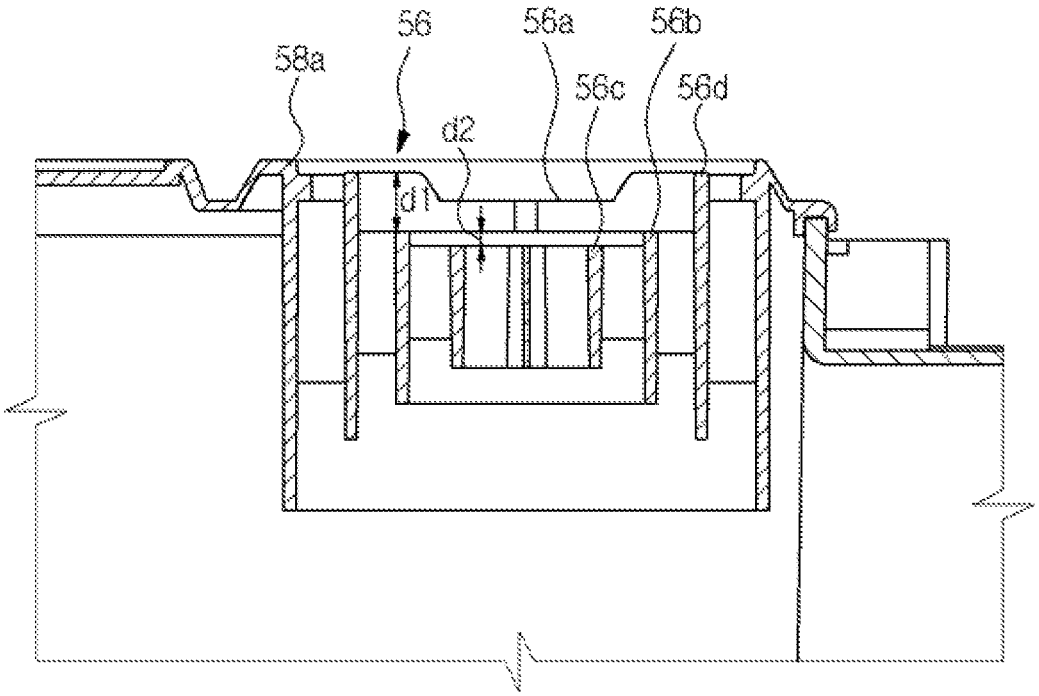
FIG. 12 is a view taken along line AA' of the drainage hole illustrated in FIG. 11.

FIG. 11 is an enlarged view illustrating a drainage hole of the recovery water tub of FIG. 9, and FIG. 12 is a view taken along line AA' of the drainage hole illustrated in FIG. 11.

As illustrated in FIGS. 11 and 12, the communication hole 56 may include at least one rib 56*a*, 56*b*, and 56*c* provided at an inner side of the communication hole 56. The communication hole 56 is provided to be inclined from an outer side to the inner side of the communication hole 56 so as to guide the condensate water to the inner side of the second water tub 50.

A first rib 56*a* may be provided at the inner side of the communication hole 56 to correspond to a shape of the communication hole 56. Also, at least one second rib 56*b* and 56*c* may be provided at an inner side of the first rib 56*a*. The second ribs 56*b* and 56*c* may be provided in plural. According to the drawings, two second ribs 56*b* and 56*c* are provided; however, aspects of the present disclosure are not limited thereto. The second rib that is positioned at an outer side of the second ribs 56*b* and 56*c* is defined as an outer second rib 56*b*, and the second rib that is positioned at an inner side of the second ribs 56*b* and 56*c* is defined as an inner second rib 56*c*.

The height of the first rib 56*a* may be larger than those of the second ribs 56*b* and 56*c*. That is, the ribs 56*a*, 56*b*, and 56*c* may be inclined toward the inner side of the communication hole 56. Also, the height of the outer second rib 56*b* may be larger than that of the inner second rib 56*c*. That is, a height difference of d1 may exist between the first rib 56*a* and the outer second rib 56*b*. Also, a height difference of d2 may exist between the outer second rib 56*b* and the inner second rib 56*c*.

Also, a protrusion part 56*d* may be provided at at least a part of the first rib 56*a* and may protrude upwardly more than the first rib 56*a*. According to the drawings, two protrusion parts 56*d* may be provided at the first rib 56*a* and may face each other. The protrusion part 56*d* may protrude lower than the top surface of the second water tub body 55. Thus, the protrusion part 56*d* may prevent the condensate water accommodated in the second water tub 50 from bouncing toward the outer side of the second water tub body 55. An upwardly-protruding bump 58*a* may be provided at the second water tub body 55 around the communication hole 56 and may prevent the condensate water from bouncing from the inner side of the second water tub 50 in a duplicate manner.

Figure 13:
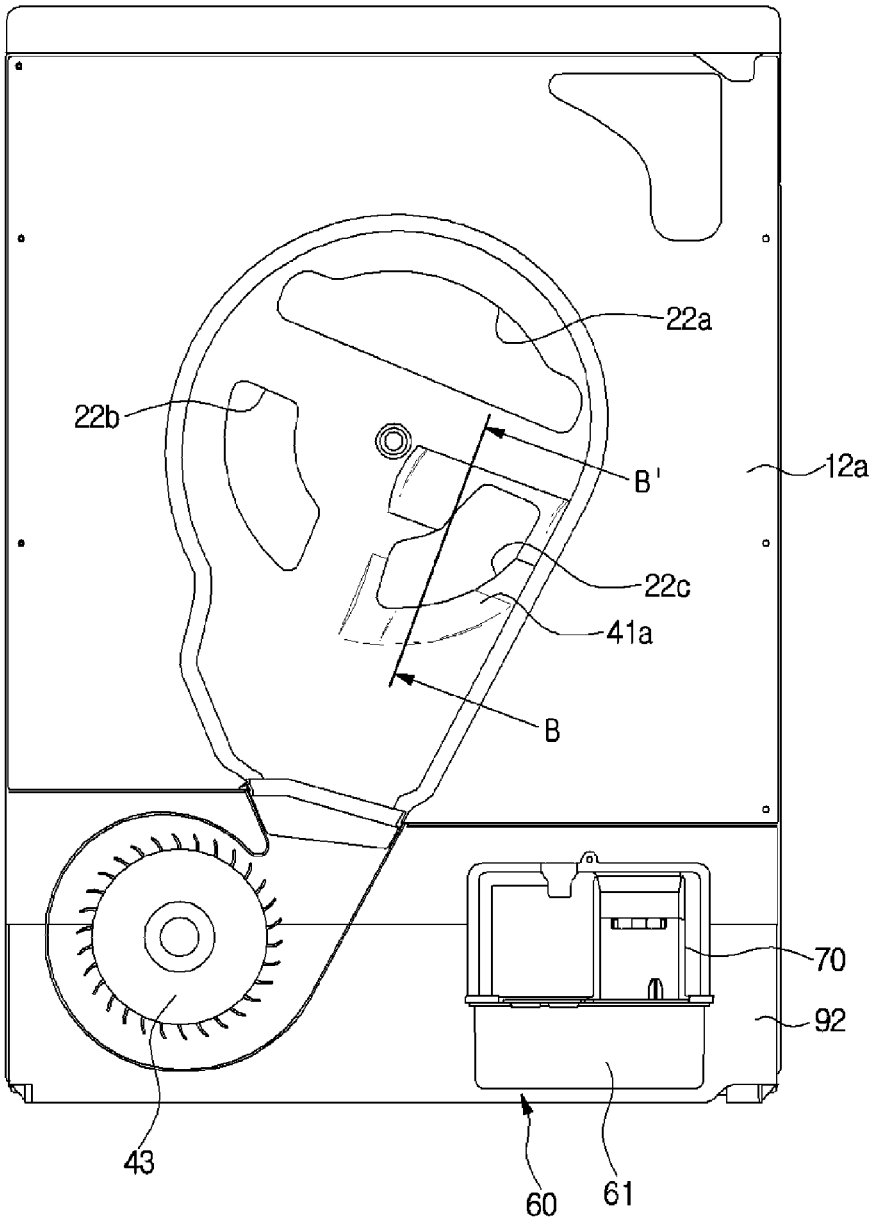
FIG. 13 is a view illustrating a rear cover according to an embodiment of the present disclosure.
Figure 14:
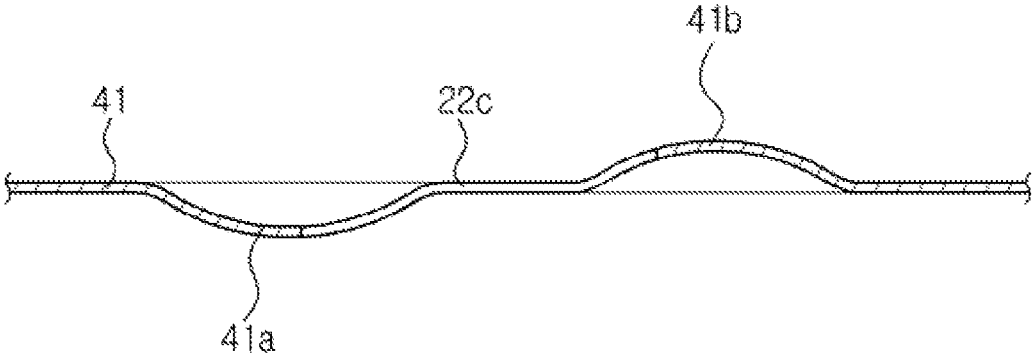
FIG. 14 is a view taken along line BB' of the rear cover illustrated in FIG. 13.

FIG. 13 is a view illustrating a rear cover according to an embodiment of the present disclosure, and FIG. 14 is a view taken along line BB' of the rear cover illustrated in FIG. 13.

As illustrated in FIGS. 13 and 14, at least one hot wind inlet 22*a*, 22*b*, and 22*c* through which high-temperature dry air flows into the drum 20, may be provided at a rear cover 12*a*. According to the drawings, the hot wind inlet 22 includes three hot wind inlets, i.e., a first hot wind inlet 22*a*, a second hot wind inlet 22*b*, and a third hot wind inlet 22*c*.

In case of the third hot wind inlet 22*c*, the blower fan 43 is disposed closer to the third hot wind inlet 22*c*. Thus, less high-temperature humid air flows in the third hot wind inlet 22*c* than in the first hot wind inlet 22*a* and the second hot wind inlet 22*b*. Thus, the high-temperature humid air does not uniformly flow into the drum 20 and drying efficiency is lowered. According to an embodiment of the present disclosure, a rear cover dent part 41*a* in which a lower side of the third hot wind inlet 22*c* is dented, may be provided. A rear cover protrusion part 41*b* in which an upper side of the third hot wind inlet 22*c* protrudes, may also be provided.

Thus, a height difference occurs in the periphery of the third hot wind inlet 22*c* and the high-temperature humid air is guided to flow into the third hot wind inlet 22*c* so that drying efficiency can be improved.

Figure 15:
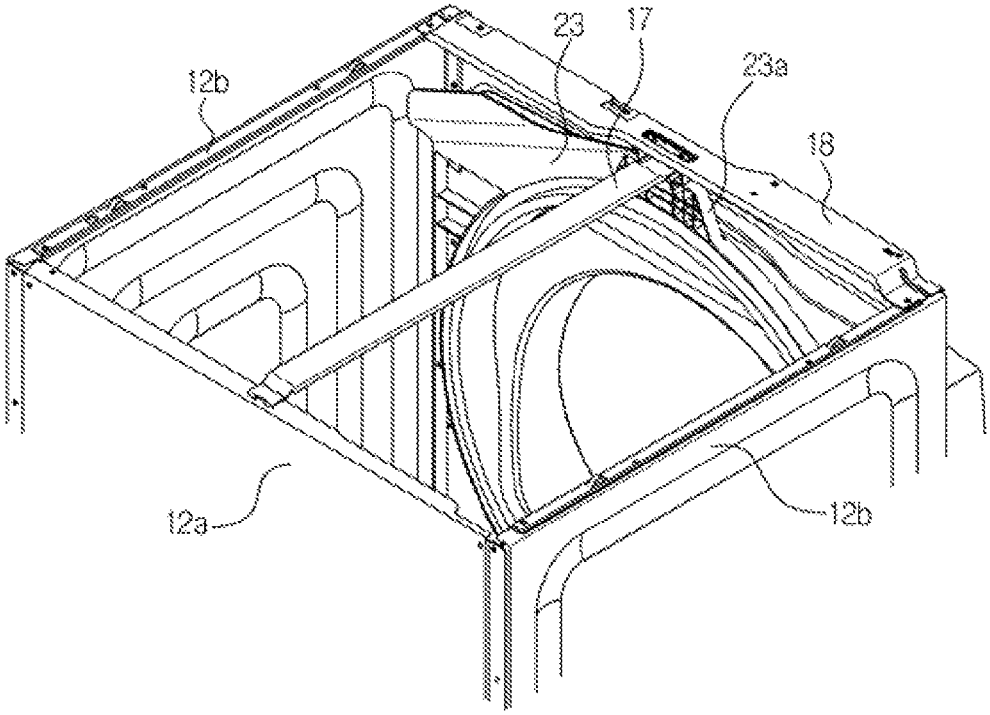
FIG. 15 is a view illustrating a state in which a deformation prevention member is combined with a frame of the clothing dryer, according to an embodiment of the present disclosure.
Figure 16:
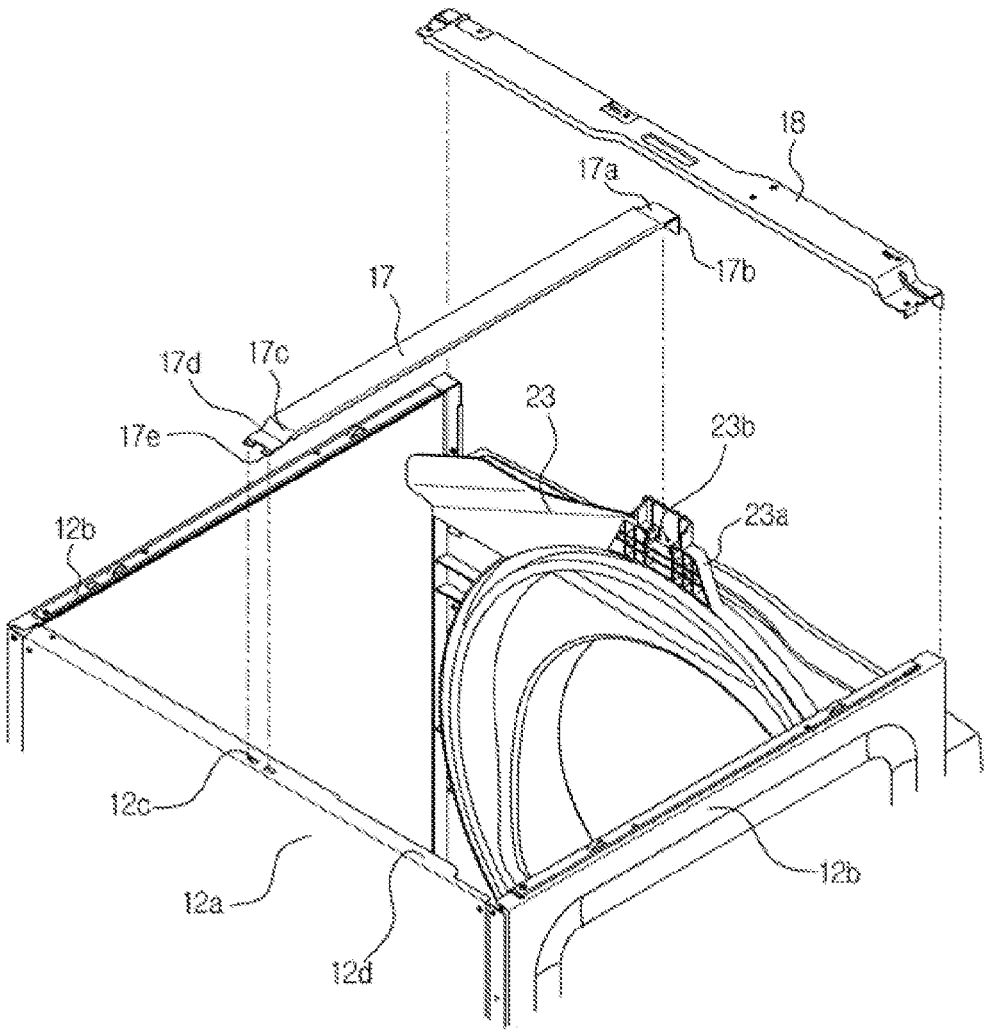
FIG. 16 is a view illustrating a state in which the deformation prevention member illustrated in FIG. 15 is disassembled from the frame of the clothing dryer.
Figure 17:
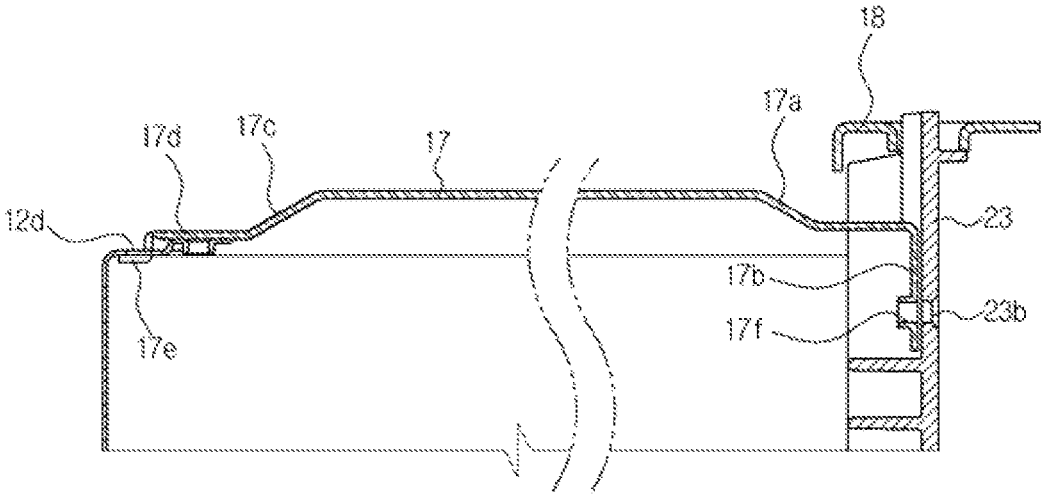
FIG. 17 is a cross-sectional view illustrating a state in which the deformation prevention member of FIG. 15 is combined with the frame of the clothing dryer.
Figure 18:
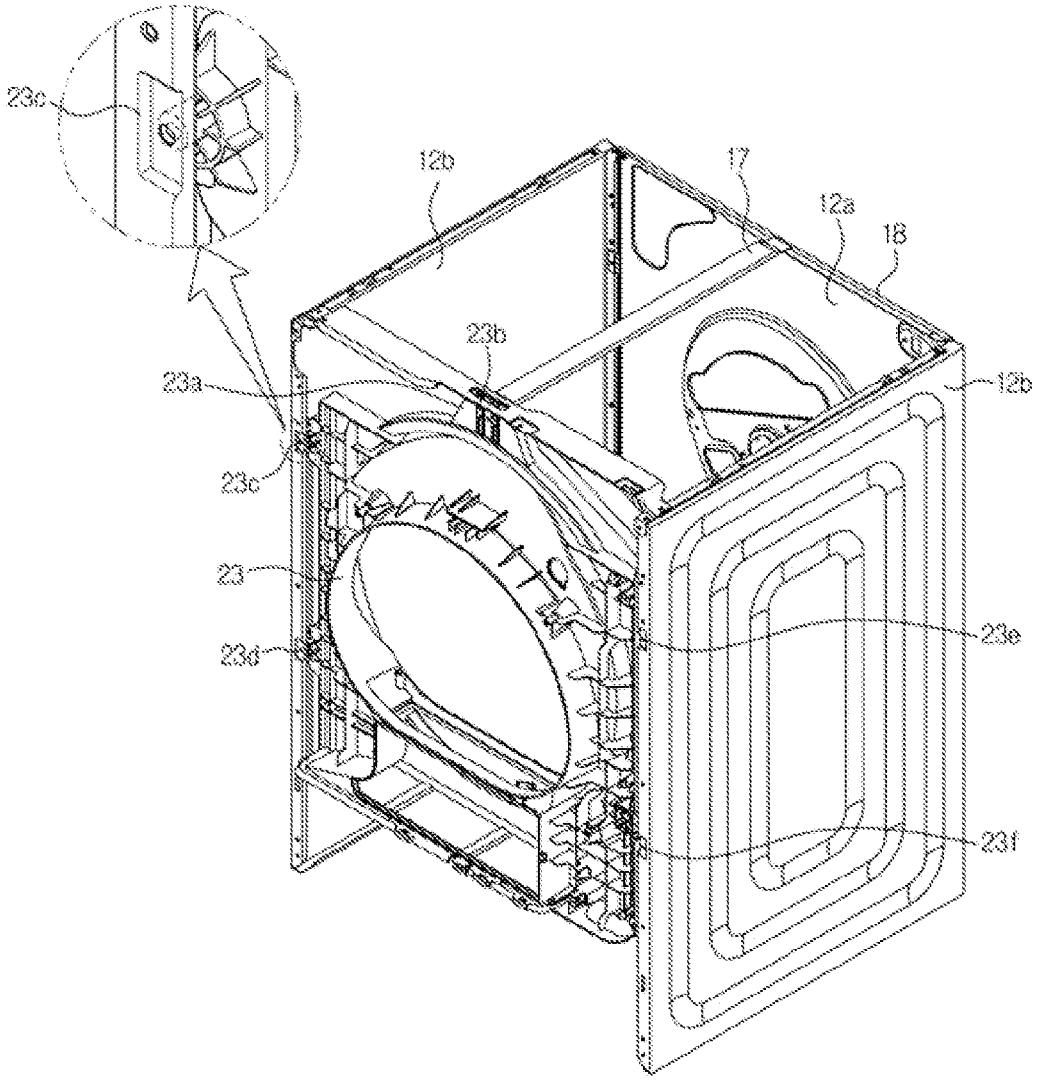
FIG. 18 is a view illustrating a state in which the deformation prevention member of FIG. 15 is combined with the frame of the clothing dryer, at a different angle.

FIG. 15 is a view illustrating a state in which a deformation prevention member is combined with a frame of the clothing dryer, according to an embodiment of the present disclosure, FIG. 16 is a view illustrating a state in which the deformation prevention member illustrated in FIG. 15 is disassembled from the frame of the clothing dryer, FIG. 17 is a cross-sectional view illustrating a state in which the deformation prevention member of FIG. 15 is combined with the frame of the clothing dryer, and FIG. 18 is a view illustrating a state in which the deformation prevention member of FIG. 15 is combined with the frame of the clothing dryer, at a different angle.

As illustrated in FIGS. 15 through 18, the clothing dryer 100 may include a deformation prevention member 17 having one side combined with a front drum 23 and the other side combined with a rear frame 12*a*.

The deformation prevention member 17 may include front combination parts 17*a* and 17*b* and rear combination parts 17*c*, 17*d*, and 17*e*. The front combination parts 17*a* and 17*b* may include a first bent part 17*a* and a second bent part 17*b* that extends from the first bent part 17*a*. The second bent part 17*b* may be bent nearly perpendicular to the first bent part 17*a* and may be combined with the front drum 23. A deformation prevention member combination part 23*a* may be provided so that at least a part of the front drum 23 can protrude upwardly. The front combination parts 17*a* and 17*b* may be mounted on the deformation prevention member combination part 23*a*.

The rear combination parts 17*c*, 17*d*, and 17*e* may include a third bent part 17*c* and a fourth bent part 17*d* that extends from the third bent part 17*c*. The rear combination parts 17*c*, 17*d*, and 17*e* may further include a combination part 17*e* that extends from the fourth bent part 17*d*. The combination part 17*e* may be inserted into a combination groove 12*c* of the rear frame 12*a*. Thus, the fourth bent part 17*d* is mounted on a top surface 12*d* of the rear frame 12*a*.

The front combination parts 17*a* and 17*b* and the front drum 23 may be combined with each other using an additional fastening member (not shown). To this end, the second bent part 17*b* may include a fastening groove 17*f*, and a fastening groove 23*b* is also provided in the deformation prevention member combination part 23*a* such that the fastening member (not shown) passes through and is combined with the fastening groove 23*b*.

Also, frame combination parts 23*c*, 23*d*, 23*e*, and 23*f* may be disposed at both sides of the front drum 23 and may be combined with both side frames 12*b*. The frame combination parts 23*c*, 23*d*, 23*e*, and 23*f* and an additional fastening member (not shown) may be inserted so that both side frames 12*b* and the front drum 23 can be combined with each other. At least one frame combination part 23*c*, 23*d*, 23*e*, and 23*f* may be provided at both sides of the front drum 23. According to the drawings, the frame combination parts 23*c*, 23*d*, 23*e*, and 23*f* are provided by two at each of both sides of the front drum 23; however, aspects of the present disclosure are not limited thereto. The frame combination parts positioned at an upper side of the drawing are defined as a first frame combination part 23*c* and a second frame combination part 23*e*, and the frame combination parts positioned at a lower side of the drawing are defined as a third frame combination part 23*d* and a fourth frame combination part 23*f*.

After the deformation prevention member 17 is mounted on the front drum 23, a top frame 18 that constitutes an additional top cover 11 may be combined with an upper side of the deformation prevention member combination part 23*a*.

Both sides of the front drum 23 may be combined with the side frames 12*b* via the first frame combination part 23*c* and the second frame combination part 23*e*, and may be combined with the rear frame 12*a* via the deformation prevention member 17. That is, the front drum 23 has a 3-point support structure in which the front drum 23 is supported by three points. The front drum 23 may be formed of a plastic material, the clothing dryer 100 uses heat so as to dry the object to be dried, and thus the front drum 23 may be deformed by heat. However, according to an embodiment of the present disclosure, the front drum 23 is combined with the frame 12 to have the 3-point support structure, and thus sagging deformation of the front drum 23 can be prevented. Also, the deformation prevention member 17 prevents an airtight state of the clothing dryer 100 so that the risk of fire that occurs by heat can be reduced.

As described above, the structure of a drainage unit of a clothing dryer according to the present disclosure is improved so that the number of components required to manufacture the drainage unit can be reduced, material cost thereof can be reduced, assembling characteristics of the drainage unit can be improved, and productivity can be improved.

In addition, the structure of the drainage unit of the clothing dryer is improved so that the user can easily select a drainage method.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drainage unit comprising:

a condensing unit to condense humid air into water;

a pump unit to discharge water condensed by the condensing unit;

a water container to store water discharged by the pump unit;

a first hose coupled to a discharge port of the pump unit to flow water toward the water container; and a cover to coupled to the pump unit, wherein the water container comprises a communication hole formed on a top surface of the water container to communicate with the first hose, and wherein the first hose is removable by access provided by a recess formed on the cover.

2. The drainage unit according to claim 1, wherein the communication hole comprises a first rib that is disposed at an inner side of the communication hole and corresponds to a shape of the communication hole and at least one second rib that is disposed at an inner side of the first rib so as to guide water flowing into the communication hole, and a height of the at least one second rib is smaller than a height of the first rib.

3. The drainage unit according to claim 2, wherein the communication hole comprises a protrusion part protruding from an upper side of the first rib so as to prevent water flowing into the communication hole from bouncing toward an outer side of the communication hole.

4. The drainage unit according to claim 1, further comprising a third hose enable to be coupled to the discharge port to drain water discharged by the pump while the first hose is removed from the discharge port.

5. A clothing dryer comprising:

a main body having a first recess at a rear side of the dryer;

a rotatable drum installed in the main body;

a condensing unit to condense humid air discharged from the drum into water;

a pump to discharge water condensed by the condensing unit and accumulated in the main body;

a discharge port though which water is to be discharged by the pump; and a cover to cover the first recess, the cover having a second recess, wherein, access to the pump is provided by the first recess while the first recess is open, and access to the discharge port is provided by the second recess while the first recess is covered by the cover.

6. The clothing dryer according to claim 5, further comprising a first hose coupled to the discharge port, at least a part of the first pipe being disposed in the second recess.

7. The clothing dryer according to claim 6, wherein the first hose is removable from the discharge port while the first recess is closed by the cover.

8. The clothing dryer according to claim 6, wherein at least one holder is provided at the cover so as to support the first hose.

9. The clothing dryer according to claim 6, further comprising a water container coupled to the first hose to store water discharged from the pump unit.

10. The clothing dryer according to claim 9, further comprising a second hose to convey water overflowed from the water container to the pump unit.

11. The clothing dryer according to claim 7, further comprising a boss disposed in the second recess configured to be coupled to the first hose while the first hose is removed from the discharge port.

12. The clothing dryer according to claim 10, further comprising an inlet coupled to the second hose, the inlet being hidden by the cover while the first recess is closed by the cover.

13. The clothing dryer according to claim 7, further comprising a third hose configured to be coupled to the discharge port to drain water discharged from the pump unit while the first hose is removed from the discharge port.

14. The clothing dryer according to claim 9, further comprising a communication hole formed on a top surface of the water container to receive water discharged from the first hose.

15. The clothing dryer according to claim 14, wherein the communication hole is provided to be inclined toward the inner side of the water container.

16. The clothing dryer according to claim 15, wherein the communication hole comprises a first rib that is disposed at an inner side of the communication hole and corresponds to a shape of the communication hole and at least one second rib that is disposed at an inner side of the first rib.

17. The clothing dryer according to claim 16, wherein a height of the second rib is smaller than a height of the first rib.

18. The clothing dryer according to claim 16, wherein the communication hole comprises a protrusion part protrudes from an upper side of the first rib so as to prevent the water flowing into the communication hole from bouncing toward an outer side of the communication hole.

19. A clothing dryer comprising:

a main body having a first recess at a rear side of the dryer;

a rotatable drum installed in the main body;

a condensing unit to condense humid air discharged from the drum into water;

a pump unit disposed in the first recess to discharge condensed water accumulated on a bottom of the main body;

a water container to store water discharged from the pump unit;

a first hose coupled to a discharge port of the pump unit to convey water to the water container; and a cover to cover the first recess, the cover having a second recess such that the discharge port is accessible by the second recess while the first recess is covered by the cover.

20. A clothing dryer comprising:

a main body having a first recess at a rear side of the dryer;

a rotatable drum installed in the body;

a condensing unit to condense humid air discharged from the drum into water;

a pump to discharge condensed water accumulated on a bottom of the main body;

a discharge port through which water is to be discharged by the pump;

a water container to store water discharged by the pump;

a first hose coupled to the discharge port to flow water to the water container;

a second hose to drain water overflowed from the water container to the bottom of the main body; and a cover to cover the first recess, the cover having a second recess such that the first hose is removable from the discharge port through access provided by the second recess while the first recess is covered by the cover.

* * * * *